US005781960A

United States Patent [19]

Kilström et al.

[11] Patent Number: 5,781,960

[45] Date of Patent: Jul. 21, 1998

[54] NOZZLE ARRANGEMENT FOR A SELF-GUIDING VACUUM CLEANER

[75] Inventors: Lars Kilström, Täby; Björn Riise, Sollentuna; Anders Haegermarck, Trångsund, all of Sweden

[73] Assignee: Aktiebolaget Electrolux, Stockholm, Sweden

[21] Appl. No.: 838,555

[22] Filed: Apr. 9, 1997

[30] Foreign Application Priority Data

Apr. 25, 1996 [SE] Sweden ..... 9601576

[51] Int. Cl.[6] ..... A47L 9/28

[52] U.S. Cl. ..... 15/319; 15/340.3; 15/354

[58] Field of Search ..... 15/340.1, 340.3, 15/354, 319

[56] References Cited

U.S. PATENT DOCUMENTS 5,095,577 3/1992 Jonas et al. ..... 15/340.1 X
5,109,566 5/1992 Kobayashi et al. ..... 15/340.1 X
5,634,237 6/1997 Paranjpe ..... 15/340.1 X
5,682,640 11/1997 Han ..... 15/340.1 X

FOREIGN PATENT DOCUMENTS 2057454 5/1972 Germany .
95/26512 10/1995 WIPO .

*Primary Examiner*—Chris K. Moore
*Attorney, Agent, or Firm*—Pearne, Gordon, McCoy and Granger LLP

[57] ABSTRACT

A self-guiding vacuum cleaner having a chassis (10) supporting a brush nozzle (50) facing the floor and having a nozzle opening (51) communicating with a chamber (16) in which a dust container (17) is arranged, the chamber being connected to the inlet side of a fan unit (33). The vacuum cleaner has a drive system for driving the vacuum cleaner on the floor, the drive system including at least two drive wheels (35) which are also arranged to guide the vacuum cleaner on the floor by relative motion of the wheels. The chassis (10) and the nozzle (50) are provided with cooperating means (48, 49) by means of which the nozzle (50) is such supported in the chassis for vertical movement.

11 Claims, 3 Drawing Sheets

NOZZLE ARRANGEMENT FOR A SELF-GUIDING VACUUM CLEANER

BACKGROUND OF THE INVENTION

The present invention relates to a device for a self-guiding vacuum cleaner including a chassis supporting a brush nozzle facing the floor and having a nozzle opening communicating with a chamber in which a dust container is arranged. The chamber is connected to an inlet side of a fan unit. The vacuum cleaner also includes a drive system for driving the vacuum cleaner on the floor, the drive system includes at least two drive wheels which are also arranged to guide the vacuum cleaner on the floor by relative motion of the wheels and an electric control system.

Vacuum cleaners of the above-mentioned type are previously known, see WO 95/26512. However, the brush nozzle of the '512 vacuum cleaner is described very schematically, and does not have the design necessary to give the best possible cleaning result. Therefore, there exists a need in the art for a vacuum cleaner brush nozzle that provides a good cleaning result and which minimizes friction losses when the nozzle moves across the floor.

SUMMARY OF THE INVENTION

The present invention provides a nozzle arrangement for a self-guiding vacuum cleaner which provides a good and even cleaning with a minimum of friction losses when the vacuum cleaner moves across the floor. The present invention also provides a flexible nozzle supporting structure that allows the nozzle to float on the floor.

In accordance with the present invention, a vacuum cleaner comprises a chassis supporting a brush nozzle and having a nozzle opening communicating with a chamber in which a dust container is arranged. A drive system for driving the vacuum cleaner across the floor comprises at least two drive wheels.

In further accordance with the present invention, the chassis and the nozzle are provided with means for supporting the nozzle within the chassis for vertical movement. The supporting means includes a horizontal arm which is pivotally supported on the chassis and on which the nozzle is arranged. The arm is pivotally mounted for vertical, oscillating movement, and for turning movement about an axis extending in a length direction of the arm.

BRIEF DESCRIPTION OF THE DRAWINGS

These and further features of the present invention will be apparent with reference to the accompanying drawings, wherein.

DETAILED DESCRIPTION OF THE PREFERRED EMBODIMENT

Figure 1:
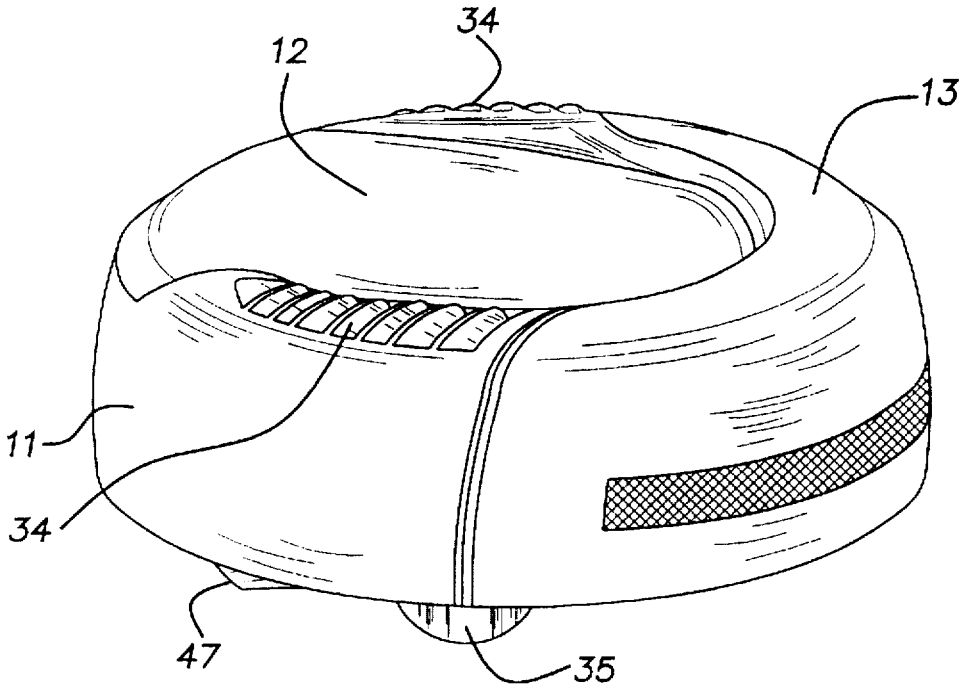
FIG. 1 is a perspective view of a self-guiding vacuum cleaner in which the device according to the present invention is used.

A self-guiding vacuum cleaner according to the present invention moves to the right in the drawing figures and comprises a chassis 10 designed as a bottom plate. The plate supports a housing 11 with a cover 12 and a front part 13 which is movable with respect to the chassis 10. The front part 13 is integrated with an obstacle sensing system, which will be described more fully hereafter.

Figure 2:
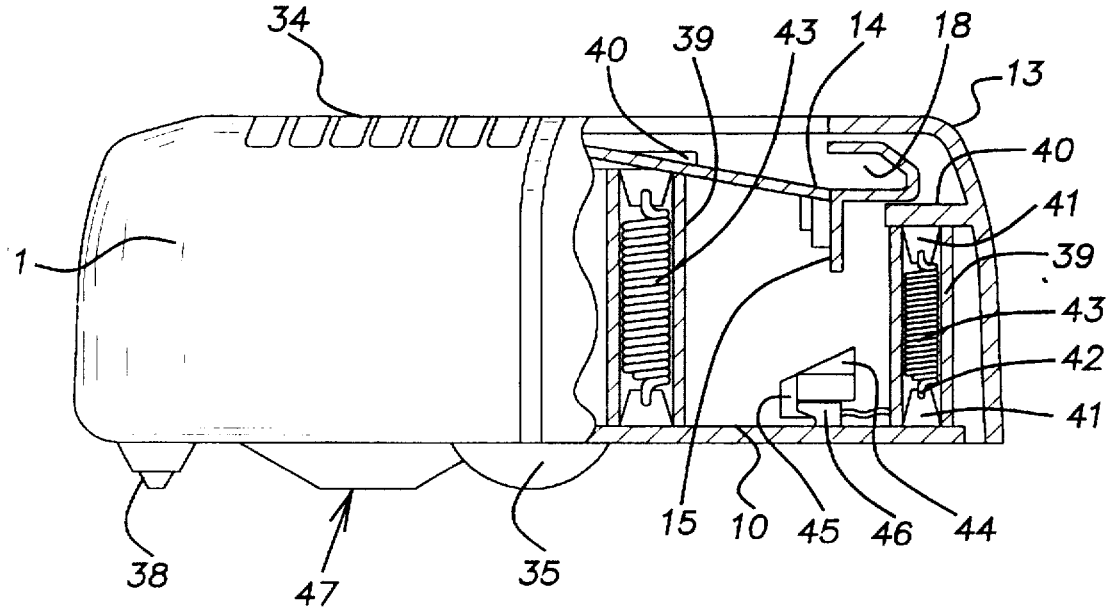
FIG. 2 is a partly broken side view of the vacuum cleaner shown in FIG. 1, and shows a supporting structure for an obstacle sensing system of the vacuum cleaner.

The cover 12 is secured to the housing 11 by a locking means 14 (FIG. 2). The housing continues immediately behind the front part 13 into an intermediate wall 15. The intermediate wall 15 is the front wall of a chamber 16 in which a dust container 17 is inserted. The intermediate wall 15 continues into a handle 18 by means of which the vacuum cleaner is carried. The chamber 16 is limited by the chassis 10, which defines a bottom of the chamber, the intermediate wall 15, side walls 19, 20, a rear wall 21 and the cover 12.

Figure 4:
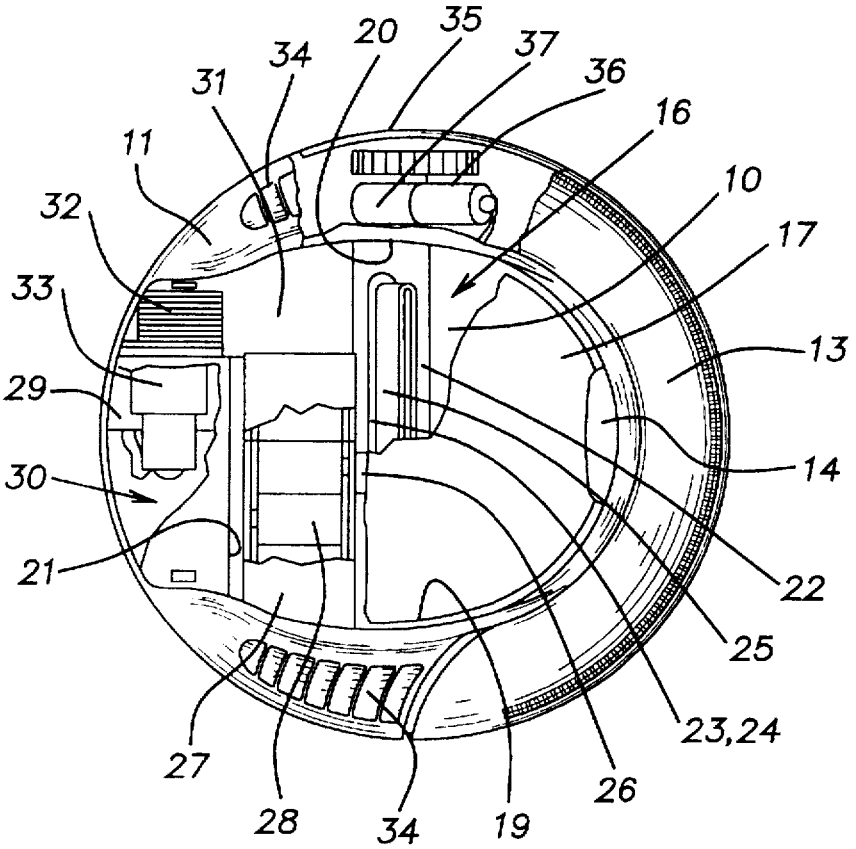
FIG. 4 is a partly broken elevational view of the vacuum cleaner, with the cover removed.
Figure 5:
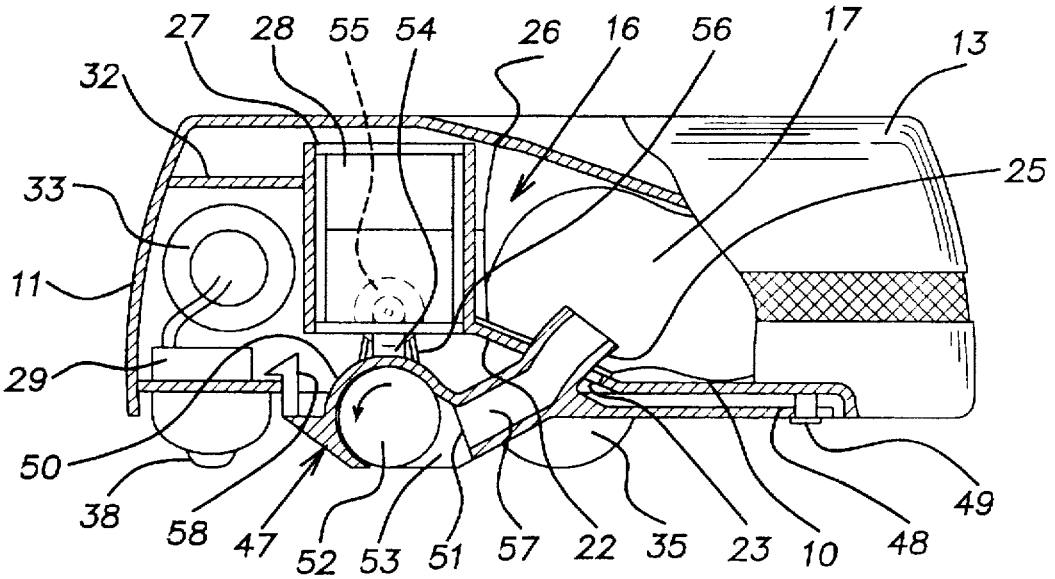
FIG. 5 is a partly broken side view of the vacuum cleaner.

The chassis 10 is shaped so that the bottom of the chamber 16 has a portion 22 slanting upwardly and rearwardly (FIGS. 4–5). The slanting bottom portion 22 has an elongated opening 23. A membrane 24 partly covers the opening 23 and is provided with a slot. A wide tube-shaped sleeve 25 extends through the opening 23 and the slot in the membrane 24. A dust container 17 is threaded onto the tube-shaped sleeve 25. The dust container 17 has, in a conventional way, a plate 26 secured to an air-pervious bag. The plate 26 has an elongated opening with a membrane which seals against the sleeve 25.

From the chamber 16, a hood 27 is accessible (FIGS. 4–5). The hood 27 covers a power source in the form of several rechargeable batteries 28 which, by means of a socket (not shown), can be connected to a charger. The batteries 28 are connected to the electric system of the vacuum cleaner and the electric system is provided with electronic circuits 29 and electric components necessary to guide and control movement of the vacuum cleaner on the floor. The electronic circuits 29 are placed in the space 30 between the chassis 10 and the housing 11 and relatively outside the chamber 16 (FIG. 4).

The chamber 16 continues into a passage 31 which, via an outlet opening 32, covered by a filter and a channel, communicates with the inlet side of a motor-fan unit 33. The outlet side of the fan unit 33 ends in the space 30 which means that the electric equipment disposed in the space 30 will be cooled by the air flowing therethrough. From the space 30, the air exits to atmosphere via outlet openings 34 in the housing 11.

The vacuum cleaner is supported by two steering and driving wheels 35. The wheels 35 are arranged diametrically opposite to each other and are driven by separate driving motors 36 via transmissions 37. Pivot wheels 38 are arranged at the rear part of the vacuum cleaner. The vacuum cleaner is designed so that its center of gravity is between the driving wheels 35 and the pivot wheels 38.

The front part 13 of the vacuum cleaner is, as previously mentioned, movable with respect to the chassis 10 by means of a resilient support. The front part 13 is a cup-shaped, half-circular screen which is a continuation of the housing 11 so that the complete vacuum cleaner, in a plan-view, has a mainly circular shape.

Figure 3:
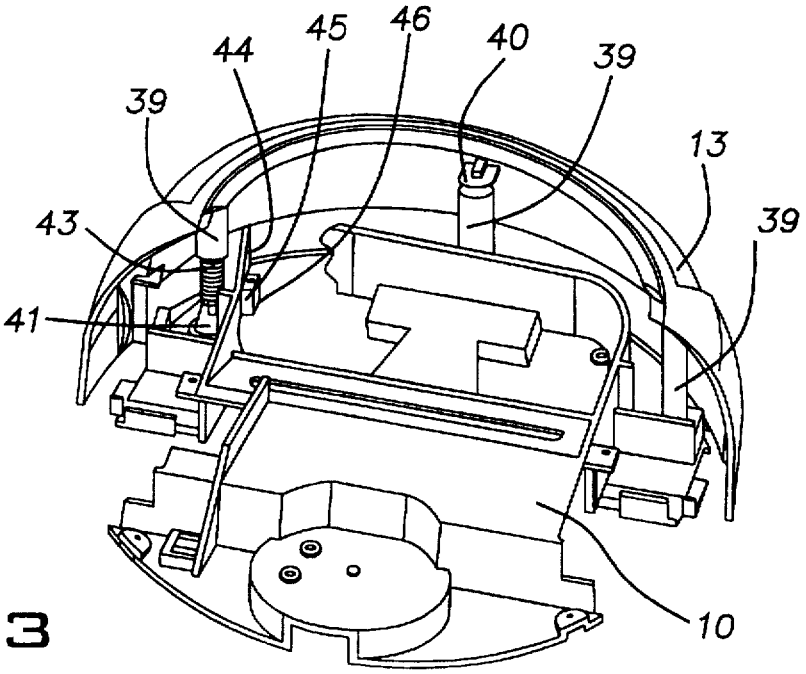
FIG. 3 is a perspective view of components of the obstacle sensing system.

The front part 13 has a tripod-type support comprising one front and two rear supporting points (FIGS. 2–3). Each supporting point is formed by a distance means including a rather stiff tube 39 placed mainly vertically between the chassis 10 and a bracket 40 arranged on the inside of the front part 13. The bracket 40 and the chassis 10 each have a conical protrusion 41 on which the tube 39 is fastened. The protrusion 41 is provided with a through-opening 42 to which the end of a tension spring 43 is secured. Thus, the front part 13 balances on the tube 39 under the influence of the springs 43 at the same time that it is secured to the chassis. The front part 13 is arranged on the chassis 10 so that it, under the influence of the springs 43, is pre-tensioned in the forward direction and the part 13 can thus be moved horizontally rearwards when the vacuum cleaner hits an obstacle. Movement of the front part 13 in the rearward direction is limited since the lower part will abut the chassis 10. During movement between the front part 13 and the chassis 10, the edge parts of the tube 39 serve as pivot points. More specifically, the front part of the upper edge of the tube 39 and the rear part of the lower edge of the tube 39 are pivot points when the front part 13 moves rearward with respect to the chassis 10.

The front part 13 further supports two brackets 44 which are directed rearwards. The brackets 44 are arranged at some distance from, and at each side of, the vertical central plane as seen in the forward direction. The brackets 44 each support a stop means 45 limiting the forward movement of the front part 13 and each cooperating with a micro switch 46 arranged on the chassis 10. The micro switches 46 are connected to the electric circuit of the vacuum cleaner and, since the stop means normally keeps the micro switch 46 in its depressed position, small movements of the front part 13 will send corresponding signals to the electric circuit. It is, of course, within the scope of the invention and possible to replace the micro switches with other known types of position indicators, if desired.

Figure 6:
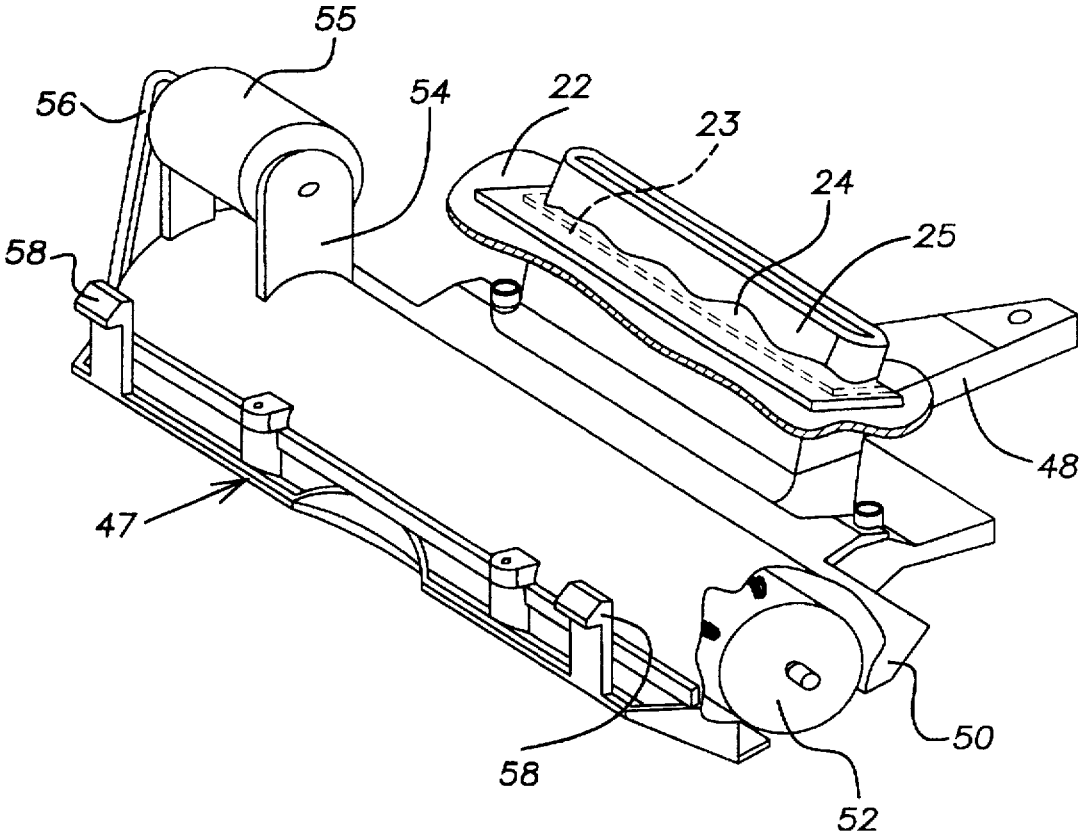
FIG. 6 is a partly broken perspective view of the vacuum cleaner nozzle.

The vacuum cleaner is also provided with a nozzle part 47 having a central front arm 48 (FIGS. 5–6). The arm 48 is disposed in a recess at the bottom side of the chassis 10, and is supported by a ball joint 49 so that the arm 48 can turn vertically about the ball joint 49 at the same time that it can turn about a horizontal axis directed in the forward direction. The rear part of the arm 48 continues into a nozzle 50 having a nozzle opening 51 extending mainly across the entire width of the vacuum cleaner. The nozzle part 50 comprises a brush roll 52 having several radially-extending brushes. The brush roll 52 is supported by bearings disposed in nozzle side walls 53.

The nozzle part 50 supports a bracket 54 on which an electric motor 55 is arranged. The electric motor 55 drives, by means of a toothed drive belt 56, the brush roll 52 via a toothed wheel (not shown) arranged at the side wall of the brush roll 52. The nozzle opening 51 is, via an inlet channel 57, connected to the sleeve 25 mentioned above. The nozzle part 50 also comprises several hooks 58 cooperating with the chassis and limiting downward movement of the nozzle. When the vacuum cleaner is used the nozzle will, thus, float on the floor.

The vacuum cleaner operates in the following way. When the vacuum cleaner has been activated and placed on a floor, movement of the vacuum is controlled by the electronic circuits which is a part of the electric circuit and which might also comprise means for orienting the vacuum cleaner or detecting the surrounding area. Steering and driving is achieved by means of the wheels 35, the circular shape of the vacuum cleaner making it possible to turn through 180° without being hindered which means that there is no risk that the vacuum cleaner will be trapped.

When the movable front part 13 of the vacuum cleaner touches an obstacle, the front part 13 will move rearwards with respect to the chassis 10 which means that the tube 39 will bend, in the case that it is flexible, at the same time that it tilts about its lower, rear pivot point while the part 13 makes a tilting movement about the upper, front pivot point of the tube 39. This movement activates one or both micro switches 46 which generates or provides a signal to the electric circuit to stop the drive motors 36. Thereafter, the electronic circuit causes the vacuum cleaner to turn so that it comes free from the obstacle whereby the movable front part 13 returns to its original position by means of the springs 43.

During movement of the vacuum cleaner across the floor, the nozzle part 47 rests by its own weight on the floor and can, because of its flexible support at the joint 49, float on the floor. At the same time, the motor 55 drives the brush roll 52 in the counter-clockwise direction in FIGS. 5 and 6 which means that the brush tufts of the brush roll 52 throw up dirt particles from the floor against the nozzle opening 51. By means of the air flow created by the fan unit 33, the dirt particles are moved through the inlet channel 57 and sleeve 25 into the dust container 17. The dirt particles are separated in the dust container 17 after which the air flows through the chamber 16, the passage 31, the outlet opening 32, the fan unit 33, the space 30 and the outlet openings 34 to atmosphere whereby the air simultaneously cools the electronic components.

While the preferred embodiment of the present invention is shown and described herein, it is to be understood that the same is not so limited but shall cover and include any and all modifications thereof which fall within the purview of the invention.

What is claimed is:

1. A self-guiding vacuum cleaner comprising a chassis (10) supporting a brush nozzle (50) facing the floor and having a nozzle opening (51) communicating with a chamber (16) in which a dust container (17) is arranged, said chamber being connected to the inlet side of a fan unit (33), a drive system for driving the vacuum cleaner on the floor, said drive system comprising at least two drive wheels (35) which are also arranged to guide the vacuum cleaner on the floor by relative motion of the wheels and an electric control system, wherein the chassis (10) and the nozzle (50) cooperate to provide means (48, 49) for supporting the nozzle (50) in the chassis for vertical movement relative to said chassis.

2. A self-guiding vacuum cleaner according to claim 1, wherein said supporting means comprises a mainly horizontal arm (48) on which the nozzle (50) is arranged, said arm being pivotably secured to the chassis.

3. A self-guiding vacuum cleaner according to claim 2, wherein the arm (48) is capable of vertical, oscillating movement relative to said chassis and turning movement about an axis extending in a length direction of the arm.

4. A self-guiding vacuum cleaner according to claim 3, wherein the nozzle opening (51) is placed in front of a brush roll (52), as seen in the direction of movement of the vacuum cleaner, and wherein a direction of rotation of the brush roll is such that the direction of movement of the brush roll over the floor is opposite to the direction of movement of the vacuum cleaner.

5. A self-guiding vacuum cleaner according to claim 1, wherein the nozzle opening (51) is placed in front of a brush roll (52) , as seen in the direction of movement of the vacuum cleaner, and wherein a direction of rotation of the brush roll is such that the direction of movement of the brush roll over the floor is opposite to the direction of movement of the vacuum cleaner.

6. A self-guiding vacuum cleaner according to claim 1, wherein the nozzle (50) supports a driving motor (55) of a brush roll.

7. A self-guiding vacuum cleaner according to claim 1, wherein the nozzle is provided with a sleeve (25) communicating with the nozzle opening (51) and which, by means of a sealed opening (23), extends into said chamber (16).

8. A self-guiding vacuum cleaner according to claim 1, wherein the nozzle supporting point (49) at the chassis is placed in the front part of the vacuum cleaner whereas the brush roll (52) is disposed between a central part and a rear part of the vacuum cleaner.

9. A self-guiding vacuum cleaner according to claim 1, wherein said nozzle comprises an arm (48) and said supporting means comprises a ball joint (49), said arm being supported in said ball joint such that said arm can turn vertically about said ball joint and about a horizontal axis extending in a length direction of said arm.

10. A self-guiding vacuum cleaner according to claim 9, wherein the nozzle opening (51) is placed in front of a brush roll (52), as seen in the direction of movement of the vacuum cleaner, and wherein a direction of rotation of the brush roll is such that the direction of movement of the brush roll over the floor is opposite to the direction of movement of the vacuum cleaner.

11. A self-guiding vacuum cleaner according to claim 9, wherein the ball joint (49) is disposed at a front part of the vacuum cleaner and a brush roll is disposed between a central and rear part of the vacuum cleaner.

* * * * *